US006908415B2

(12) United States Patent
Branson

(10) Patent No.: US 6,908,415 B2
(45) Date of Patent: Jun. 21, 2005

(54) EXERCISE APPARATUS FOR RECREATIONAL AND REHABILITATIVE EXERCISE AND METHOD OF EXERCISE THEREFOR

(76) Inventor: Michael Branson, 9215 N. 107th Way, Scottsdale, AZ (US) 85258

( * ) Notice: Subject to any disclaimer, the term of this patent is extended or adjusted under 35 U.S.C. 154(b) by 0 days.

(21) Appl. No.: 10/427,244

(22) Filed: May 1, 2003

(65) Prior Publication Data

US 2004/0220018 A1 Nov. 4, 2004

(51) Int. Cl.[7] ..... A63B 71/00
(52) U.S. Cl. ..... 482/51; 482/95; 434/255
(58) Field of Search ..... 482/51, 95, 96, 482/114, 131, 148; 434/247, 255; 472/16

(56) References Cited

U.S. PATENT DOCUMENTS 3,101,944 A * 8/1963 Cencig ..... 482/114
3,589,720 A * 6/1971 Agamian ..... 482/114
4,324,399 A * 4/1982 Rickey ..... 482/142
4,506,884 A * 3/1985 Hankin ..... 482/131
4,921,242 A * 5/1990 Watterson ..... 482/72
4,960,276 A * 10/1990 Feuer et al. ..... 482/70
4,989,860 A * 2/1991 Iams et al. ..... 482/132
5,322,493 A * 6/1994 Venner ..... 482/131
5,393,282 A * 2/1995 Maclean ..... 482/70
5,509,870 A * 4/1996 Lloyd ..... 482/51
5,607,374 A * 3/1997 Hesse ..... 482/51
5,632,707 A * 5/1997 Daniel et al. ..... 482/8
5,643,162 A * 7/1997 Landers et al. ..... 482/131
5,800,312 A * 9/1998 Ormondroyd ..... 482/51
5,833,584 A * 11/1998 Piaget et al. ..... 482/70
5,941,803 A * 8/1999 Chamberlain et al. ..... 482/96
6,468,187 B1 * 10/2002 Boatwright ..... 482/95

* cited by examiner

*Primary Examiner*—Gregory L. Huson
*Assistant Examiner*—Tam Nguyen
(74) *Attorney, Agent, or Firm*—Craig Weiss; Veronica-Adele Cao; Weiss, Moy & Harris, PC

(57) ABSTRACT

An exercise apparatus for recreational and rehabilitative exercise comprising in combination, a substantially square-shaped slide board having a substantially level top surface with a low coefficient of friction, and at least one sliding device for allowing a user to maneuver any combination of his hands, elbows, feet, and knees or posterior torso across the slide board and methods of exercise wherein the individual may use functional movements as well as unilateral and bilateral movements with both upper and lower extremities and wherein the exercise allows the individual's body to move in an anatomical plane that is sagittal, frontal, transverse, oblique or in a combination thereof.

12 Claims, 4 Drawing Sheets

EXERCISE APPARATUS FOR RECREATIONAL AND REHABILITATIVE EXERCISE AND METHOD OF EXERCISE THEREFOR

FIELD OF THE INVENTION

This invention relates generally to exercise apparatuses and methods of exercise and, more specifically, to an exercise apparatus and method for recreational and rehabilitative exercise having the characteristics of portability, convenience and ease of use while providing various modes of exercise for building and strengthening a user's targeted muscle group.

BACKGROUND OF THE INVENTION

Exercise may be performed to serve two purposes; recreation and rehabilitation. Many individuals exercise for entertainment or to relieve stress. Other individuals, however, are required to perform certain exercises in order to rebuild damaged or weakened muscle tissue. Regardless of the motivation for exercise, the result is that the individual is not only stimulating muscle hypertrophy, but also maintaining and strengthening all of his physiological systems.

There are three fundamental anatomical planes in which an individual's body may move; sagittal, frontal, and transverse. The sagittal plane divides the body into a right and left half. The frontal plane divides the body into an anterior half and a posterior half. And the transverse plane, which is at right angles to both the frontal and sagittal planes, divides the body into upper and lower halves. A body may also move in a combination of these planes. For example, a body may move diagonally in an oblique plane. This oblique plane is a combination of the sagittal and frontal planes. A body may also move in an elliptical direction, thus moving in a combination of all three fundamental planes plus the oblique plane.

There are also various types of exercise modes designed to stimulate muscle hypertrophy; concentric (muscle-shortening), eccentric (muscle-lengthening), isometric (muscle loading at one joint position), isotonic (constant tension), and isokinetic (constant speed). However, many types of exercise equipment are designed only to allow for movement in a certain plane or limit the user to performing only a specific exercise mode.

U.S. Pat. No. 5,509,870 discloses a slide board that allows a user to mimic the motions of speed skaters and hockey players by sliding in a predominately lateral direction. This device has side blocks that minimize the user's lateral movement and hold the device in place during such vigorous exercise. Because of the type of exercise for which this device is intended, however, the device is fairly large and cumbersome. Furthermore, the user is limited to performing the functional movement of skating. Also, with this type of exercise, a user will not be strengthening the muscle groups in his upper extremities.

U.S. Pat. No. D428,454 describes a device comprising a platform portion which the individual may grasp while in a quadruped position. The platform is set upon four wheels that allow the platform to roll in all directions, thereby requiring the user to employ his abdominal muscles to control the device. However, a problem arises when the device is used on carpet. The wheels may become caught on long or stray carpet fibers. Furthermore, the device cannot be used effectively on tiled floors because the wheels will become stuck in the grooves between the tiles.

Therefore a need existed for a portable device for recreational and rehabilitative exercise comprising in combination, a substantially square-shaped slide board having a substantially level top surface with a low coefficient of friction, and at least one sliding device for allowing a user to maneuver any combination of his hands, elbows, feet, and knees or posterior torso across the slide board.

A further need existed for methods of exercise wherein the individual may use functional movements as well as unilateral and bilateral movements with both upper and lower extremities and wherein the exercise allows the individual's body to move in an anatomical plane that is sagittal, frontal, transverse, oblique or in a combination thereof.

SUMMARY OF THE INVENTION

An object of the present invention is to provide an improved device for recreational and rehabilitative exercise and exercise methods therefor.

Another object of the present invention is to provide an exercise apparatus for recreational and rehabilitative exercise comprising in combination, a substantially square-shaped slide board having a substantially level top surface with a low coefficient of friction, and at least one sliding device with a low coefficient of friction for allowing a user to maneuver at least one of a hand, elbow, foot, knee and posterior torso across the slide board, thereby causing the user to utilize a targeted muscle group.

Another object of the present invention is to provide an improved method of exercise using bilateral movements with both upper and lower extremities such that the body of the user moves in at least one anatomical plane and wherein the at least one anatomical plane is sagittal, frontal, transverse, oblique or a combination thereof.

Yet another object of the present invention is to provide a method of exercise using unilateral movements with both upper and lower extremities such that the body of the user moves in at least one anatomical plane and wherein the at least one anatomical plane is sagittal, frontal, transverse, oblique or a combination thereof.

BRIEF DESCRIPTION OF THE PREFERRED EMBODIMENTS

In accordance with one embodiment of the present invention, an exercise apparatus for recreational and rehabilitative exercise comprising in combination, a slide board for set up upon a floor area and having a top surface, the top surface having a low coefficient of friction and at least one sliding device for allowing a user to maneuver at least one of a hand, elbow, foot, knee and posterior torso across the slide board, thereby causing the user to utilize a targeted muscle group. The sliding device has a bottom surface with a low coefficient of friction for sliding across the slide board and also has a top surface dimensioned to receive at least one of a hand, elbow, foot, knee and posterior torso.

In accordance with another embodiment of the present invention, a method of exercise using bilateral movements comprising the steps of positioning at least two of the user's extremities onto at least two corresponding sliding devices wherein the at least two extremities are two hands, two elbows, two feet, two knees or any combination thereof, and contracting and relaxing the target muscle groups in each of the at least two extremities so as to maneuver the at least two sliding devices across the top surface of the slide board in a slide pattern such that the body of the user moves in at least one anatomical plane and wherein the at least one anatomical plane is sagittal, frontal, transverse, oblique or a combination thereof.

In accordance with yet another embodiment of the present invention, a method of exercise using unilateral movements comprising the steps of positioning at least one of the user's extremities onto at least one corresponding sliding device wherein the at least one extremity is one of a hand, an elbow, a foot, or a knee, and contracting and relaxing the target muscle groups in the at least one extremity so as to maneuver the at least one sliding device across the top surface of the slide board in a slide pattern such that the body of the user moves in at least one anatomical plane and wherein the at least one anatomical plane is sagittal, frontal, transverse, oblique or a combination thereof.

The foregoing and other objects, features, and advantages of the invention will be apparent from the following, more detailed description of the preferred embodiments of the invention, as illustrated in the accompanying drawings.

DETAILED DESCRIPTION OF THE PREFERRED EMBODIMENTS

Figure 1:
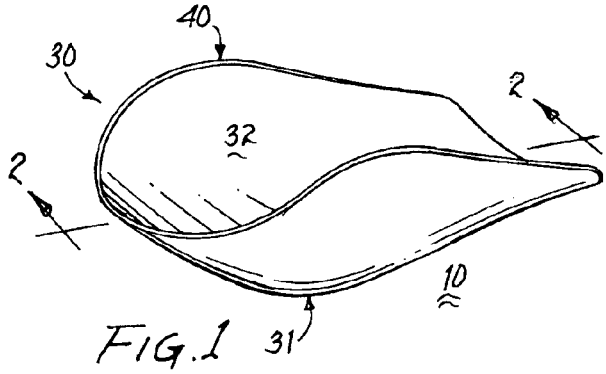
FIG. 1 is a perspective view of a sliding pad-type sliding device of the preferred exercise apparatus embodiment of the present invention.
Figure 2:
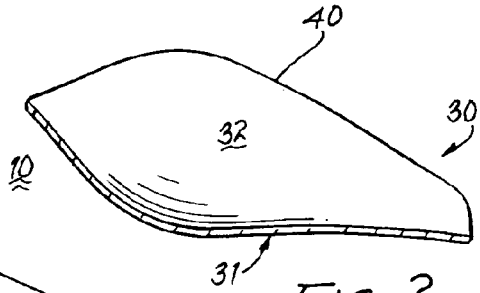
FIG. 2 is a cross-sectional view of the sliding pad-type sliding device of FIG. 1, taken along line 2—2 of FIG. 1.
Figure 3:
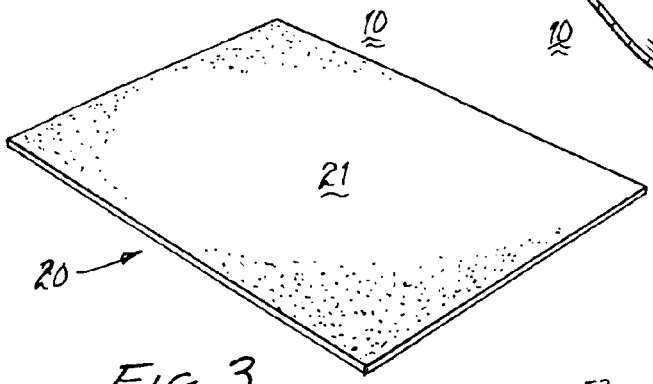
FIG. 3 is a perspective view of a slide board of the preferred exercise apparatus embodiment of the present invention.
Figure 5:
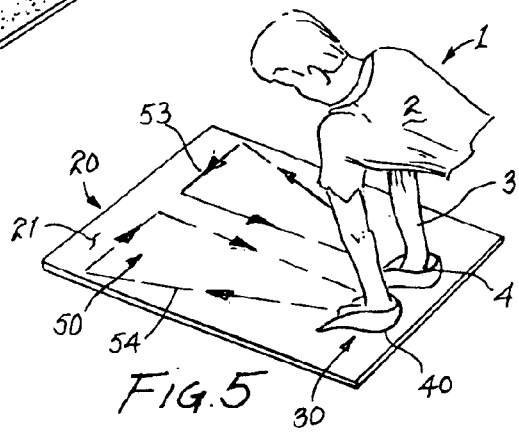
FIG. 5 is a perspective view of the exercise apparatus of FIG. 4A, shown with the user in a resting quadruped position for bilateral movement exercise (slide patterns allowing the user's body to move in sagittal, transverse and oblique planes are shown in phantom lines).

FIGS. 1–3 refer to the preferred embodiment of the invention. Together, they show an exercise apparatus 10 for recreational and rehabilitative exercise comprising a substantially square-shaped slide board 20 and at least one sliding device 30. The slide board 20 is set up upon a floor area (not shown) and has a top surface 21 that is substantially level and has a low coefficient of friction. The at least one sliding device 30 allows a user 1 (see FIG. 5) to maneuver at least one of a hand 4, elbow 5, foot 7 (see FIG. 4A), knee 8 and posterior torso 2 across the slide board 20, thereby causing the user 1 to utilize a targeted muscle group (not shown).

Figure 7B:
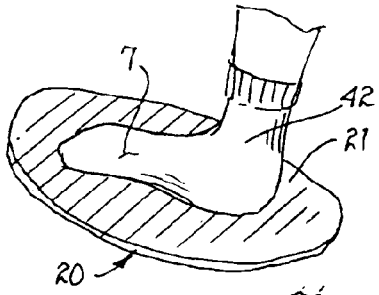
FIG. 7B is an enlarged perspective view of a sock-type sliding device, shown receiving a foot of the user and positioned on top of the slide board.
Figure 7A:
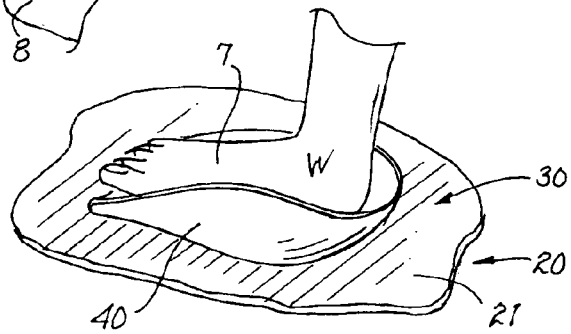
FIG. 7A is an enlarged perspective view of the sliding pad-type sliding device of FIG. 1, shown receiving a foot of the user and positioned on top of the slide board.
Figure 11:
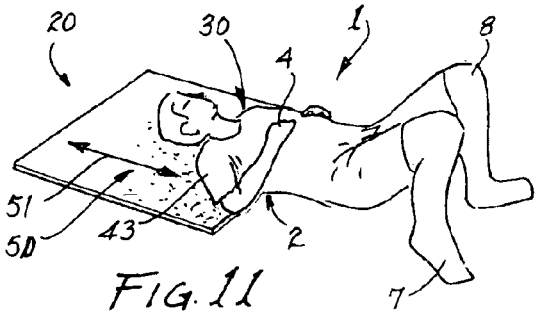
FIG. 11 is a perspective view of a shirt-type sliding device, shown with the user lying in a resting supine position (arrow indicates a slide pattern allowing the user's body to move in a sagittal plane).

FIGS. 1 and 2 disclose the at least one sliding device 30 as being a sliding pad 40. However, the sliding device 30 may comprise other materials such as a cloth 41 (see FIG. 4B), a sock 42 (see FIG. 7B), a shirt 43 (see FIG. 11), or the like. All of these materials have a bottom surface 31 (see FIG. 1) with a low coefficient of friction for sliding across the slide board 20. As shown in FIG. 1, the sliding pad 40 has a top surface 32 dimensioned to receive at least one of a hand 4, elbow 5, foot 7, and knee 8.

STATEMENT OF OPERATION

Many of the Figures disclose a method of exercise 110 using bilateral movements for building and strengthening a targeted muscle group of a body of a user 1 comprising the steps of providing a substantially square-shaped slide board 20 and at least two sliding devices 30. The slide board 20 is set up upon a floor area (not shown) and has a top surface 21 that is substantially level and has a low coefficient of friction. The at least two sliding devices 30 each have a bottom surface 31 (see FIG. 1) with a low coefficient of friction for sliding across the slide board 20 and have a top surface 32 (see FIG. 1) dimensioned to receive one of a hand 4, elbow 5, foot 7, and knee 8.

Figure 10:
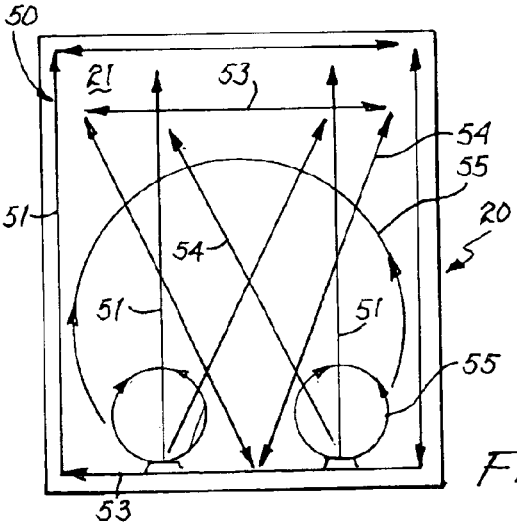
FIG. 10 is a top view of the slide board of the preferred exercise apparatus embodiment of the present invention, shown with slide patterns that allow the user's body to move in sagittal, transverse, frontal, and oblique planes and in combinations thereof.
Figure 9:
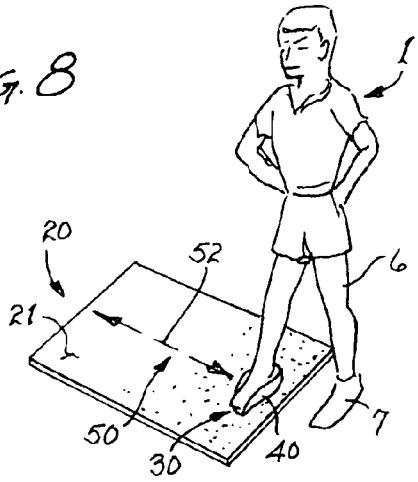
FIG. 9 is a perspective view of the exercise apparatus of FIG. 4A, shown with the user at rest in a standing position for unilateral movement exercise and facing in a direction substantially perpendicular to the slide board (a slide pattern allowing the user's body to move in a frontal plane is shown in phantom lines).

To perform this exercise 110 the user 1 will position at least two extremities onto the corresponding at least two sliding devices 30 wherein the at least two extremities are two hands 4 (see FIG. 4A), two elbows 5 (see FIG. 18A), two feet 7 (see FIG. 20), two knees 8 (see FIG. 13) or any combination thereof (not shown). With this type of exercise 110, the user 1 must contract and relax the target muscle groups (not shown) in each of the at least two extremities so as to maneuver the at least two sliding devices 30 across the top surface 21 of the slide board 20 in a slide pattern 50 (see FIG. 4A) such that the body of the user 1 moves in at least one anatomical plane and wherein the at least one anatomical plane is sagittal 51 (see FIG. 10), frontal 52 (see FIG. 9), transverse 53 (see FIG. 10), oblique 54 (see FIG. 10) or a combination 55 (see FIGS. 6, 10, 12, 15 and 22) thereof.

Figure 4A:
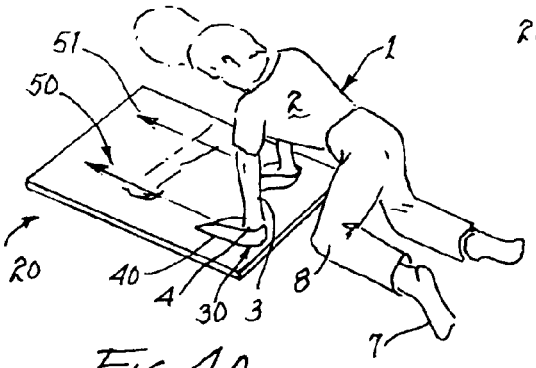
FIG. 4A is a perspective view of the preferred exercise apparatus embodiment of the present invention, shown with a user in a resting quadruped position for bilateral movement exercise (the user in a slide pattern allowing the user's body to move in a sagittal plane is shown in phantom lines).
Figure 4B:
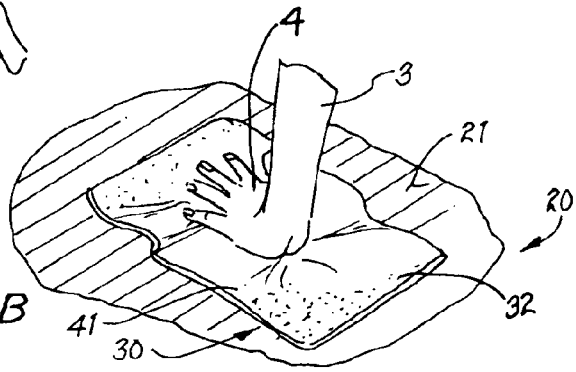
FIG. 4B is an enlarged perspective view of a cloth-type sliding device, shown receiving a hand of the user and positioned on top of the slide board.
Figure 6:
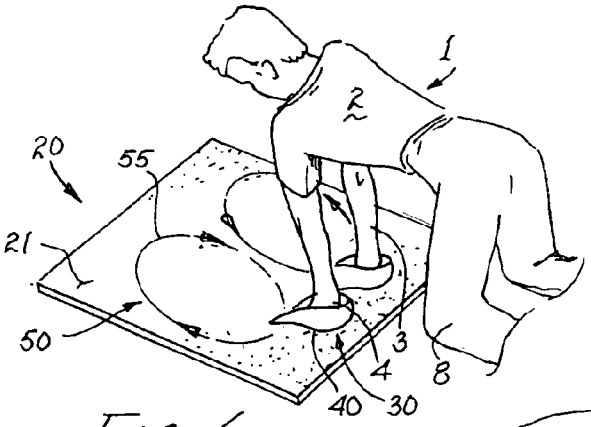
FIG. 6 is a perspective view of the exercise apparatus of FIG. 4A, shown with the user in a resting quadruped position for bilateral movement exercise (slide patterns allowing the user's body to move in a combination of sagittal, transverse, frontal, and oblique planes are shown in phantom lines).
Figure 18B:
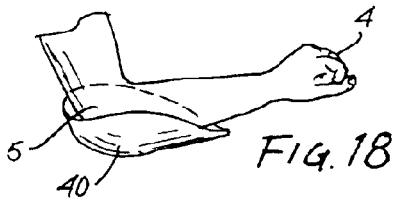
FIG. 18B is a side view of the sliding device of FIG. 1, shown receiving an elbow of the user (a larger sized sliding device is shown in phantom lines).
Figure 18A:
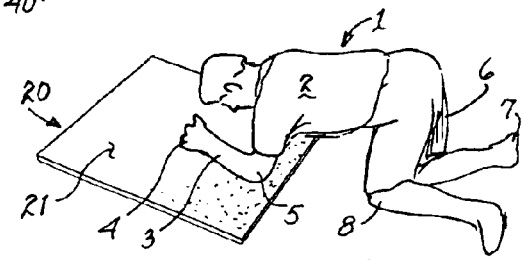
FIG. 18A is a perspective view of the user in a resting quadruped position for bilateral movement exercise, shown with the user's elbows positioned on top of the slide board and with his knees firmly positioned on the floor area substantially contiguous to the slide board.

When performing this exercise 110, the at least two sliding devices 30 may be maneuvered alternatively or in unison. Also the at least two extremities positioned onto the at least two sliding devices 30 may be two upper extremities 3. FIG. 4A shows the two upper extremities 3 as being two hands 4, while FIG. 18A shows the two upper extremities 3 as being two elbows 5. This position requires the user 1 to contract and relax the target muscle groups (not shown) in each of two lower extremities 6 (see FIGS. 4A, 6, 16, 18A, and 22) firmly positioned on the floor area (not shown) substantially contiguous to the slide board 20 so as to provide the user 1 with stability and balance during performance of the exercise 110. The two lower extremities 6 may be either two feet 7 (not shown) or two knees 8 (shown in FIG. 4A).

Figure 13:
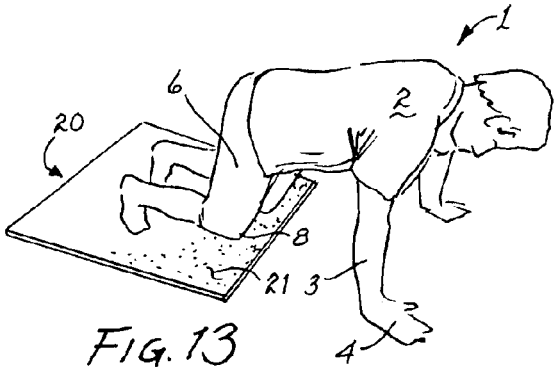
FIG. 13 is a perspective view of the user in a resting quadruped position for bilateral movement exercise, shown with the user's knees positioned on top of the slide board and with his hands firmly positioned on the floor area substantially contiguous to the slide board.
Figure 20:
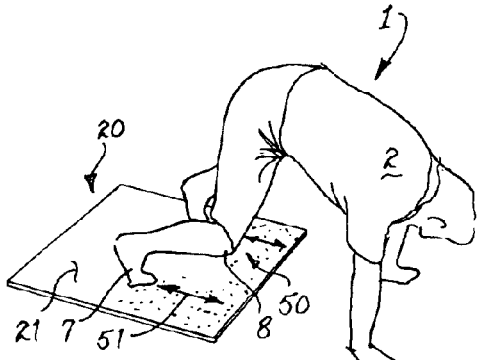
FIG. 20 is a perspective view of the user in a resting quadruped position for bilateral movement exercise, shown with the user's feet positioned on top of the slide board and with his hands firmly positioned on the floor area substantially contiguous to the slide board (arrows indicate a slide pattern allowing the user's body to move in a sagittal plane).
Figure 21:
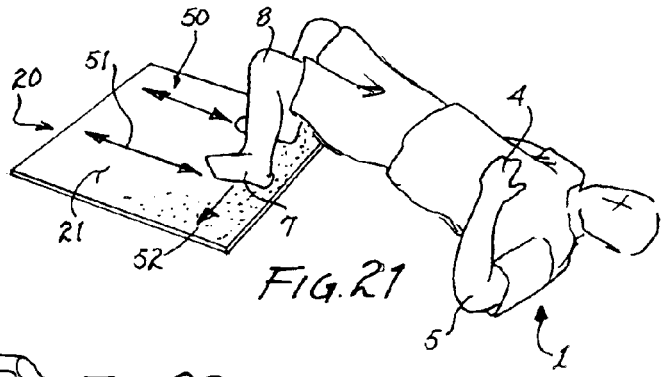
FIG. 21 is a perspective view of the user in a resting supine position with his feet positioned on top of the slide board (arrows indicate slide patterns allowing the user's body to move in sagittal, transverse, and frontal planes).
Figure 22:
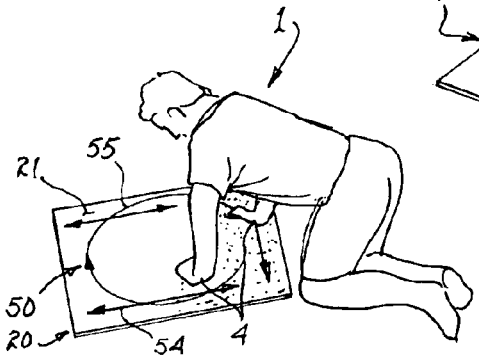
FIG. 22 is a perspective view of the user in a resting quadruped position for bilateral movement exercise, shown with the user's hands positioned on top of the slide board and with his knees firmly positioned on the floor area substantially contiguous to the slide board (arrows indicate slide patterns allowing the user's body to move in a combination of sagittal, transverse, frontal, and oblique planes.

The at least two extremities positioned onto the at least two sliding devices 30 may also be two lower extremities 6. FIG. 20 shows the two lower extremities 6 as being two feet 7, while FIG. 13 shows the two lower extremities 6 as being two knees 8. This position requires the user 1 to contract and relax the target muscle groups (not shown) in each of two upper extremities 3 (see FIGS. 13, 20, and 21) firmly positioned on the floor area (not shown) substantially contiguous to the slide board 20 so as to provide the user 1 with stability and balance during performance of the exercise 110. The two upper extremities 3 may be either two hands 4 (shown in FIG. 20) or two elbows 5 (shown in FIG. 21).

The exercise 110 may also be performed wherein a combination of both upper extremities 3 and both lower extremities 6 are positioned onto the corresponding sliding devices 30 such that the user 1 may maneuver the sliding devices 30 by utilizing functional movements (not shown).

Many of the Figures also disclose a method of exercise 210 using unilateral movements for building and strengthening a targeted muscle group of a body of a user 1 comprising the steps of providing a substantially square-shaped slide board 20 and at least one sliding device 30. The slide board 20 is set up upon a floor area (not shown) and has a top surface 21 that is substantially level and has a low coefficient of friction. The at least one sliding device 30 has a bottom surface 31 (see FIG. 1) with a low coefficient of friction for sliding across the slide board 20 and have a top surface 32 (see FIG. 1) dimensioned to receive one of a hand 4, elbow 5, foot 7, and knee 8.

To perform the exercise 210, the user 1 will position at least one extremity onto the corresponding at least one sliding device 30 wherein the at least one extremity is a hand 4, an elbow 5, a foot 7, or a knee 8. The user will then contract and relax the target muscle groups (not shown) in the at least one extremity so as to maneuver the at least one sliding device 30 across the top surface 21 of the slide board 20 in a slide pattern 50 such that the body of the user 1 moves in at least one anatomical plane and wherein the at least one anatomical plane is sagittal (see FIG. 10), frontal 52 (see FIG. 9), transverse 53 (see FIG. 10), oblique 54 (see FIG. 10) or a combination 55 (see FIG. 6) thereof.

Figure 14:
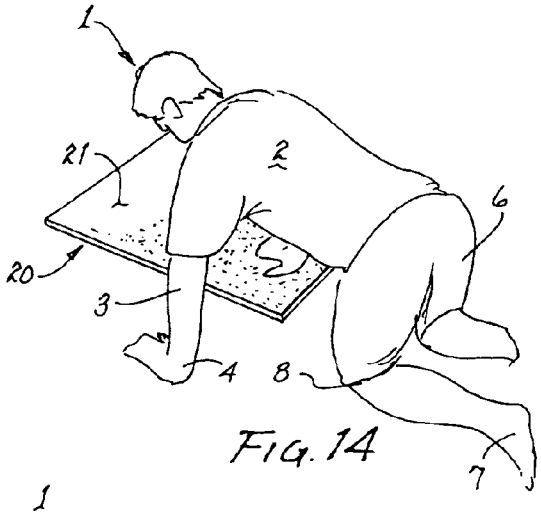
FIG. 14 is a perspective view of the user in a resting quadruped position for unilateral movement exercise, shown with one hand positioned on top of the slide board and with his other hand and both knees firmly positioned on the floor area substantially contiguous to the slide board.
Figure 15:
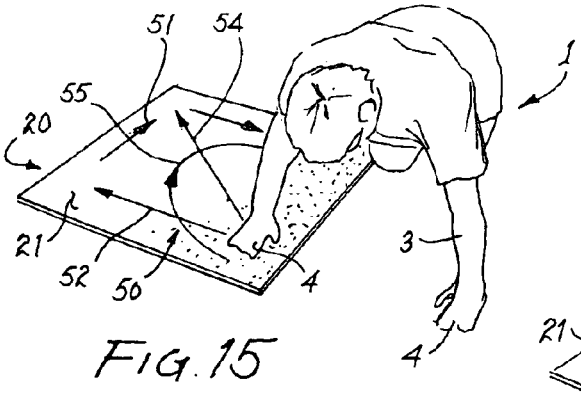
FIG. 15 is a perspective view of the user of FIG. 15, shown with arrows indicating slide patterns allowing the user's body to move in a combination of sagittal, transverse, frontal, and oblique planes.
Figure 16:
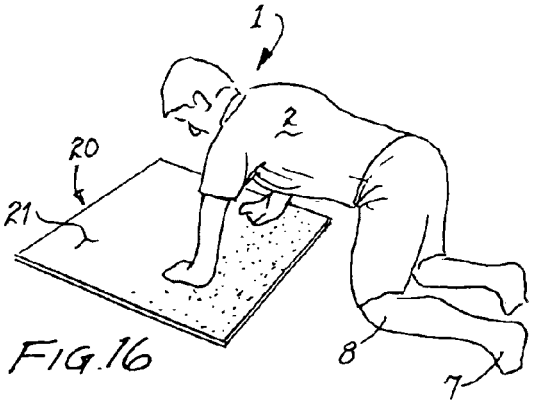
FIG. 16 is a perspective view of the user in a resting quadruped position for bilateral movement exercise, shown with the users hands positioned on top of the slide board and with his knees firmly positioned on the floor area substantially contiguous to the slide board.
Figure 17:
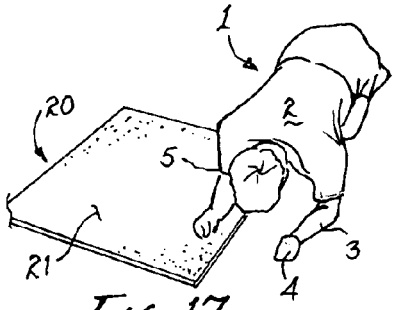
FIG. 17 is a perspective view of the user in a resting quadruped position for unilateral movement exercise, shown with one elbow positioned on top of the slide board and with his other elbow and both knees firmly positioned on the floor area substantially contiguous to the slide board.

This exercise 210 may be performed when the user is in a quadruped position (see FIG. 17). The at least one extremity positioned onto the at least one sliding device 30 may be an upper extremity 3. FIG. 15 shows the upper extremity 3 as being a hand 4, while FIG. 17 shows the upper extremity 3 being an elbow 5. This position requires the user to contract and relax the target muscle groups (not shown) in each of two lower extremities 6 and another upper extremity 3 (see FIGS. 14, 15, and 17) firmly positioned on the floor area (not shown) substantially contiguous to the slide board 20 so as to provide the user 1 with stability and balance during performance of the exercise 210. The two lower extremities 6 may be either two feet 7 (not shown) or two knees 8 (shown in FIG. 17) and the other upper extremity 3 may be a hand 4 (shown in FIG. 15) or an elbow (shown in FIG. 17).

This exercise 210 may also be performed when the at least one extremity positioned onto the at least one sliding device

Figure 12:
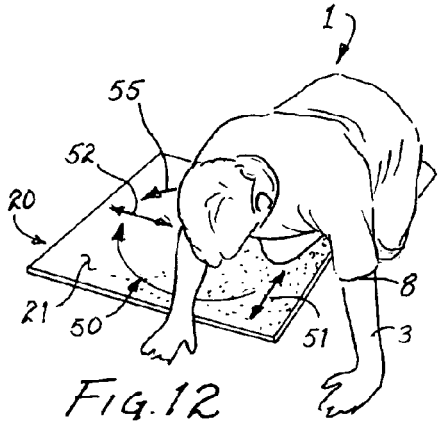
FIG. 12 is a perspective view of the user in a resting quadruped position for unilateral movement exercise, shown with one of the user's knees positioned on top of the slide board and with his other knee and hands firmly positioned on the floor area substantially contiguous to the slide board (slide patterns are shown for allowing the user's body to move in a combination of sagittal, transverse, frontal, and oblique planes).
Figure 19:
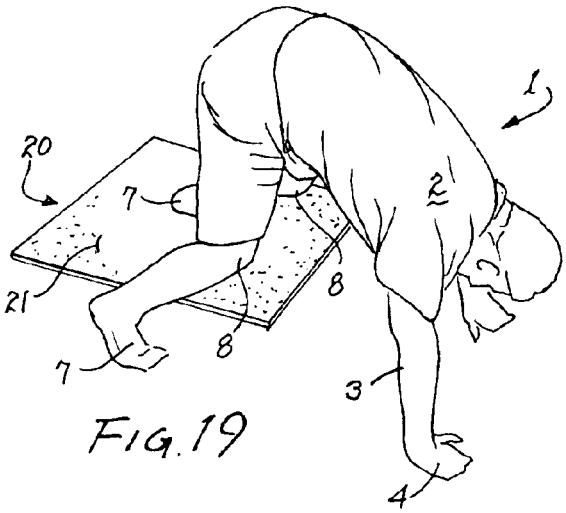
FIG. 19 is a perspective view of the user in a resting quadruped position for unilateral movement exercise, shown with one foot positioned on top of the slide board and with his other foot and both hands firmly positioned on the floor area substantially contiguous to the slide board.

30 is a lower extremity 6. FIG. 19 shows the lower extremity 6 as being a foot 7, while FIG. 12 shows the lower extremity 6 as being a knee 8. This position requires the user 1 to contract and relax the target muscle groups (not shown) in each of two upper extremities 3 and another lower extremity 6 (see FIGS. 12 and 19) firmly positioned on the floor area (not shown) substantially contiguous to the slide board 20 so as to provide the user 1 with stability and balance during performance of the exercise 210. The two upper extremities 3 may be either two hands 4 (shown in FIG. 19) or two elbows 5 (not shown) and the other lower extremity 6 may be a foot 7 (shown in FIG. 19) or an knee 8 (shown in FIG. 12).

Figure 8:
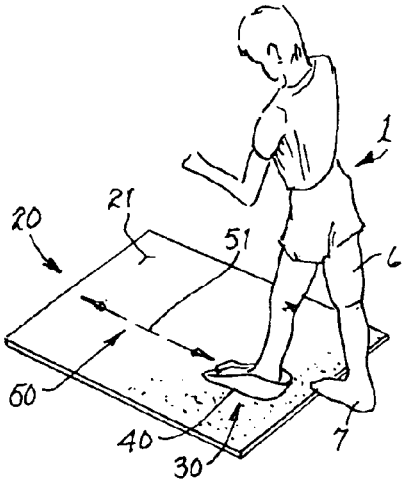
FIG. 8 is a perspective view of the exercise apparatus of FIG. 4A, shown with the user at rest in a standing position for unilateral movement exercise and squarely facing the slide board with one foot being received into the sliding device of FIG. 1 and with the other foot firmly positioned on the floor area substantially contiguous to the slide board (a slide pattern allowing the user's body to move in a sagittal plane is shown in phantom lines).

This exercise 210 may be performed when the user 1 is in a standing position and is substantially squarely facing the slide board 20 (see FIG. 8). Upon sliding his foot 7 forward, the user 1 descends into a lunge position (not shown). This exercise 210 may also be performed when the user is in a standing position and is facing in a direction substantially perpendicular to the slide board (see FIG. 9). Upon sliding his foot 7 laterally, the user 1 descends into a lateral squat (not shown).

While the invention has been particularly shown and described with reference to preferred embodiments thereof, it will be understood by those skilled in the art that the foregoing and other changes in form and details may be made therein without departing from the spirit and scope of the invention.

What is claimed is:

1. A method of exercise using bilateral movements for building and strengthening a targeted muscle group of a body of a user comprising the steps of:

providing a slide board for set up upon a floor area and having a top surface, the top surface having a low coefficient of friction;

providing at least two sliding pads, each of the at least two sliding pads having a bottom surface with a low coefficient of friction for sliding across the top surface of the slide board and having a top surface dimensioned to receive at least one of a hand, elbow, foot, and knee;

positioning at least two extremities of the user onto the corresponding at least two sliding pads wherein the at least two extremities are one of two hands, two elbows, two feet, two knees and any combination thereof; and contracting and relaxing the target muscle groups in each of the at least two extremities so as to maneuver the at least two sliding pads across the top surface of the slide board in a slide pattern such that the at least two extremities of the user are capable of moving in at least two anatomical planes while at the same time the body of the user is capable of maintaining its original position and wherein the at least two anatomical planes are at least two of a sagittal plane, a frontal plane, a transverse plane, and an oblique plane;

wherein a combination of both upper extremities and both lower extremities are positioned onto the corresponding sliding pads such that the user may maneuver the sliding pads by utilizing functional movements.

2. The method of claim 1 wherein the at least two sliding pads are maneuvered alternatively.

3. The method of claim 1 wherein the at least two sliding pads are maneuvered in unison.

4. The method of claim 1 wherein the at least two extremities positioned onto the at least two sliding pads are two upper extremities, the two upper extremities being one of two hands and two elbows.

5. The method of claim 4 including the step of contracting and relaxing the target muscle groups in each of two lower extremities firmly positioned on the floor area substantially contiguous to the slide board so as to provide the user with stability and balance during performance of the exercise, the two lower extremities being one of two feet and two knees.

6. The method of claim 1 wherein the at least two extremities positioned onto the at least two sliding pads are two lower extremities, the two lower extremities being one of two feet and two knees.

7. The method of claim 6 including the step of contracting and relaxing the target muscle groups in each of the two upper extremities firmly positioned on the floor area substantially contiguous to the slide board so as to provide the user with stability and balance during performance of the exercise, the two upper extremities being one of two hands and two elbows.

8. A method of exercise using unilateral movements for buildings and strengthening a targeted muscle group of a body of a user comprising the steps of:

providing a slide board for set up upon a floor area and having a top surface, the top surface having a low coefficient of friction;

providing at least one sliding pad, the at least one sliding pad having a bottom surface with a low coefficient of friction for sliding across the top surface of the slide board and having a top surface dimensioned to receive at least one of a hand, elbow, foot, and knee;

positioning at least one extremity of the user onto the corresponding at least one sliding pad wherein the at least one extremity is one of a hand, an elbow, a foot, and a knee; and contracting and relaxing the target muscle groups in the at least one extremity so as to maneuver the at least one sliding pad across the top surface of the slide board in a slide pattern such that the at least one extremity of the user is capable of moving in at least two anatomical planes while at the same time the body of the user is capable of maintaining its original position and wherein the at least two anatomical planes are at least two of a sagittal plane, a frontal plane, a transverse plane, and an oblique plane;

wherein the user is in a quadruped position; and wherein the at least one extremity positioned onto the at least one sliding pad is an upper extremity, the upper extremity being one of a hand and an elbow.

9. The method of claim 8 including the step of contracting and relaxing the target muscle groups in each of the two lower extremities and another upper extremity firmly positioned on the floor area substantially contiguous to the slide board so as to provide the user with stability and balance during the performance of the exercise, the two lower extremities being one of two feet and two knees and the other upper extremity being one of a hand and an elbow.

10. The method of claim 8 wherein the at least one extremity positioned onto the at least one sliding pad is a lower extremity, the lower extremity being one of a foot and a knee.

11. The method of claim 10 including the step of contracting and relaxing the target muscle groups in each of the two upper extremities and another lower extremity firmly positioned on the floor area substantially contiguous to the slide board so as to provide the user with stability and balance during performance of the exercise, the two upper extremities being one of two hands and two elbows and the other lower extremity being one of a foot and a knee.

12. A method of exercise using bilateral movements for building and strengthening a targeted muscle group of a body of a user comprising the steps of:

providing a slide board for set up upon a floor area and having a top surface, the top surface having a low coefficient of friction;

providing at least two sliding pads, each of the at least two sliding pads having a bottom surface with a low coefficient of friction for sliding across the top surface of the slide board and having a top surface dimensioned to receive at least one of a hand, elbow, foot, and knee;

positioning at least two extremities of the user onto the corresponding at least two sliding pads wherein the at least two extremities are one of two hands, two elbows, two feet, two knees and any combination thereof;

contracting and relaxing the target muscle groups in each of the at least two extremities so as to maneuver the at least two sliding pads across the top surface of the slide board in a slide pattern such that the at least two extremities of the user are capable of moving in at least two anatomical planes while at the same time the body of the user is capable of maintaining its original position and wherein the at least two anatomical planes are at least two of a sagittal plane, a frontal plane, a transverse plane, and an oblique plane;

wherein the at least two extremities positioned onto the at least two sliding pads are two upper extremities, the two upper extremities being one of two hands and two elbows; and contracting and relaxing the target muscle groups in each of two lower extremities firmly positioned on the floor area substantially contiguous to the slide board so as to provide the user with stability and balance during performance of the exercise, the two lower extremities being one of two feet and two knees.

* * * * *